US011404231B2

(12) United States Patent
Sakai

(10) Patent No.: US 11,404,231 B2
(45) Date of Patent: Aug. 2, 2022

(54) CONTACT POINT DEVICE AND ELECTROMAGNETIC RELAY

(71) Applicant: Panasonic Intellectual Property Management Co., Ltd., Osaka (JP)

(72) Inventor: Satoshi Sakai, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/286,935

(22) PCT Filed: Sep. 19, 2019

(86) PCT No.: PCT/JP2019/036814
§ 371 (c)(1),
(2) Date: Apr. 20, 2021

(87) PCT Pub. No.: WO2020/100424
PCT Pub. Date: May 22, 2020

(65) Prior Publication Data

US 2021/0358707 A1 Nov. 18, 2021

(30) Foreign Application Priority Data

Nov. 13, 2018 (JP) ..... JP2018-213164

(51) Int. Cl.
*H01H 50/38* (2006.01)
*H01H 50/10* (2006.01)
(Continued)

(52) U.S. Cl.
CPC ..... *H01H 50/38* (2013.01); *H01H 50/10* (2013.01); *H01H 50/18* (2013.01); *H01H 50/54* (2013.01); *H01H 50/546* (2013.01)

(58) Field of Classification Search
CPC ..... H01H 50/546; H01H 50/38
(Continued)

(56) References Cited

U.S. PATENT DOCUMENTS 5,892,194 A * 4/1999 Uotome ..... H01H 51/065 335/154
5,973,581 A * 10/1999 Jacquin ..... H01H 51/065 335/131
(Continued)

FOREIGN PATENT DOCUMENTS

| | | |
|---|---|---|
| JP | 2013-232341 | 11/2013 |
| JP | 2016-201286 | 12/2016 |
| JP | 2018-160423 | 10/2018 |

OTHER PUBLICATIONS

International Search Report of PCT application No. PCT/JP2019/036814 dated Nov. 26, 2019.

*Primary Examiner* — Alexander Talpalatski
(74) *Attorney, Agent, or Firm* — Greenblum & Bernstein, P.L.C.

(57) ABSTRACT

A contact point device includes: a fixed contact; a movable contactor that has a movable contact capable of being in contact with the fixed contact by moving in parallel with a first direction, and extended along a second direction orthogonal to the first direction; a containing chamber that contains the fixed contact and the movable contact; and a shielding wall disposed inside the containing chamber. The containing chamber has a first space and a second space, the shielding wall faces the first space or the second space, the shielding wall includes a partition wall located between the first space and the second space, the first space and the second space are disposed side by side in a third direction orthogonal to the first direction and the second direction, and
(Continued)

the partition wall is located in the first direction from the fixed contact and the movable contact.

13 Claims, 8 Drawing Sheets

(51) Int. Cl.
*H01H 50/18* (2006.01)
*H01H 50/54* (2006.01)

(58) Field of Classification Search
USPC ..... 335/126, 131
See application file for complete search history.

(56) References Cited

U.S. PATENT DOCUMENTS

| | | | | |
|---|---|---|---|---|
| 8,653,917 | B2 * | 2/2014 | Takaya | H01H 9/443 335/131 |
| 9,508,509 | B2 * | 11/2016 | Kashimura | H01H 33/182 |
| 2015/0015350 | A1 | 1/2015 | Tachikawa et al. | |
| 2016/0300676 | A1 | 10/2016 | Sakai et al. | |

* cited by examiner

CONTACT POINT DEVICE AND ELECTROMAGNETIC RELAY

CROSS-REFERENCE TO RELATED APPLICATIONS

This application is a U.S. national stage application of the PCT International Application No. PCT/JP2019/036814 filed on Sep. 19, 2019, which claims the benefit of foreign priority of Japanese patent application No. 2018-213164 filed on Nov. 13, 2018, the contents all of which are incorporated herein by reference.

TECHNICAL FIELD

The present disclosure relates to a contact point device and an electromagnetic relay, and more particularly to a contact point device including a fixed contact and a movable contactor, and an electromagnetic relay including this contact point device.

BACKGROUND ART

The electromagnetic relay described in PTL 1 includes a pair of fixed contacts, a movable contact that contacts and separates the pair of fixed contacts, and a drive device that drives a movable shaft to cause the movable contactor to contact and separate the pair of fixed contacts.

CITATION LIST

Patent Literature

PTL 1: Unexamined Japanese Patent Publication No. 2016-201286

SUMMARY OF THE INVENTION

A contact point device according to one aspect of the present disclosure includes: a fixed contact; a movable contactor that has a movable contact capable of being in contact with the fixed contact by moving in parallel with a first direction, and extended along a second direction orthogonal to the first direction; a containing chamber that contains the fixed contact and the movable contact; and a shielding wall disposed inside the containing chamber. The containing chamber has a first space and a second space, the shielding wall faces the first space or the second space, the shielding wall includes a partition wall located between the first space and the second space, the first space and the second space are disposed side by side in a third direction orthogonal to the first direction and the second direction, and the partition wall is located in the first direction from the fixed contact and the movable contact.

The electromagnetic relay according to one aspect of the present disclosure includes the contact point device and an electromagnet device. The electromagnet device has an exciting coil.

The contact point device and the electromagnetic relay of the present disclosure can improve arc extinguishing performance.

DESCRIPTION OF EMBODIMENT

Hereinafter, a contact point device and an electromagnetic relay according to an exemplary embodiment will be described with reference to the drawings. However, the following exemplary embodiment is only one of the various exemplary embodiments of the present disclosure. The following exemplary embodiment can be variously modified according to design and the like as long as an object of the present disclosure can be achieved. Further, each figure described in the following exemplary embodiment is a schematic view, and each ratio of a size and a thickness of each component in the figure does not necessarily reflect an actual dimensional ratio.

Electromagnetic relay 1 (see FIG. 2) is provided in, for example, an electric vehicle or the like. Electromagnetic relay 1 switches, for example, presence or absence of supply of a current from a power source to a motor of an electric vehicle.

Figure 2:
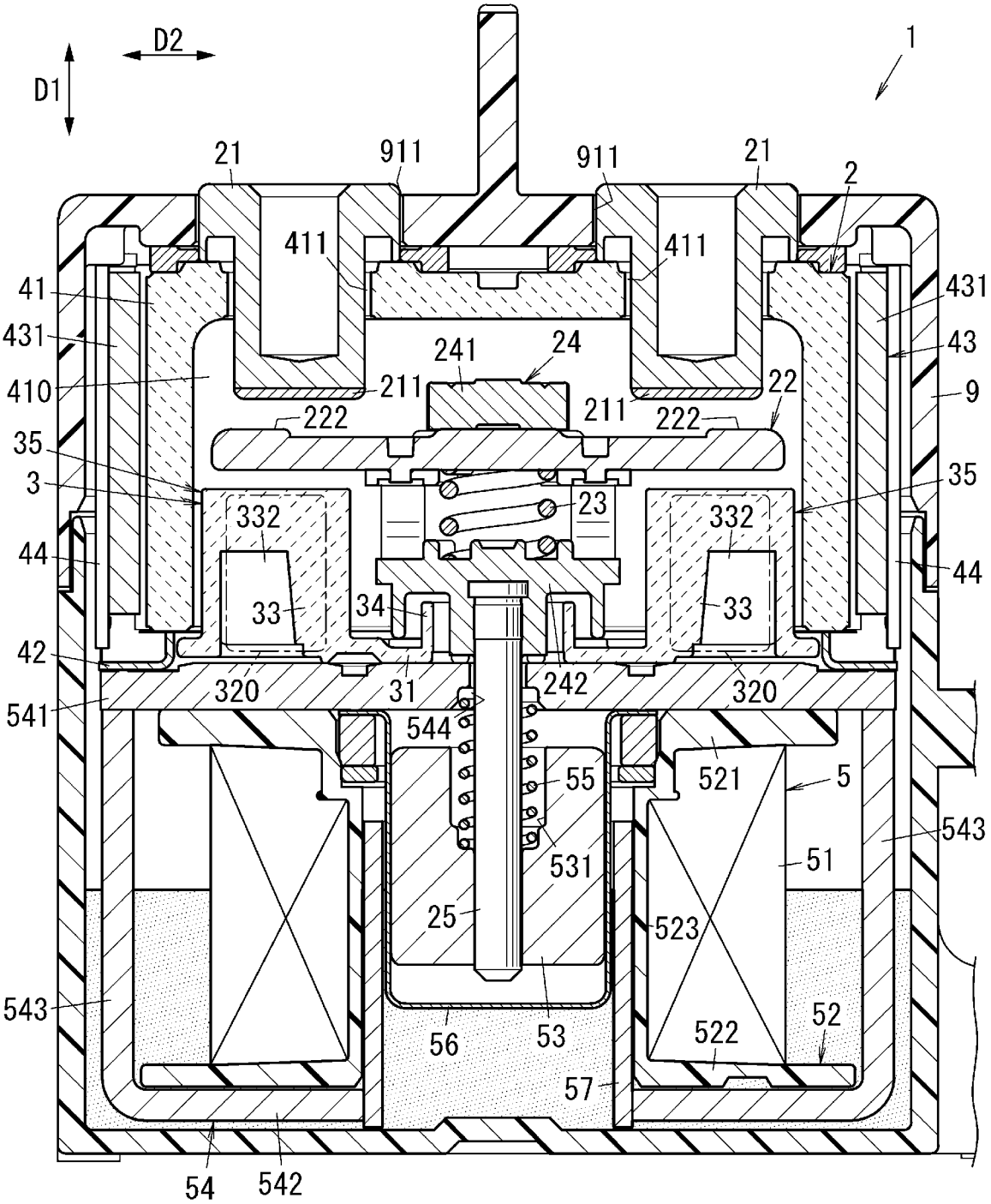
FIG. 2 is a cross-sectional view of the same electromagnetic relay as viewed from the front.

As shown in FIG. 2, electromagnetic relay 1 of the present exemplary embodiment includes contact point device 2 and electromagnet device 5.

Electromagnetic relay 1 further includes housing 9 that contains contact point device 2 and electromagnet device 5. Housing 9 is airtight. As shown in FIG. 2, contact point device 2 includes a plurality of (two in FIG. 2) fixed contacts 211, movable contactor 22, and shielding member 3. Contact point device 2 further includes a plurality of (two in FIG. 2) fixed terminals 21, contact pressure spring 23, holder 24, drive shaft 25, inner case 41, joining body 42, and magnetic flux generator 43.

In the following, a direction in which each fixed contact 211 and corresponding movable contact 222 are disposed side by side is defined as an up-down direction, and a side of fixed contact 211 as viewed from movable contact 222 is defined as an upper side, and a side of movable contact 222 as viewed from fixed contact 211 is defined as a lower side. Further, in electromagnetic relay 1, a direction in which two fixed contacts 211 are disposed side by side is defined as a right-left direction. However, these directions are not intended to limit a direction in which electromagnetic relay 1 is used.

Each of the plurality of fixed terminals 21 is formed of a conductive material such as copper. A shape of each of fixed terminals 21 is cylindrical. Each of fixed terminals 21 is inserted into a through hole 411 formed in inner case 41. Further, each of fixed terminals 21 is inserted into through hole 911 formed in housing 9. Each of fixed terminals 21 is bonded to inner case 41 by brazing in a state where an upper end of fixed terminal 21 is protruded from an upper surface of inner case 41 and an upper surface of housing 9.

The plurality of fixed terminals 21 correspond to the plurality of fixed contacts 211 one-to-one. Corresponding fixed contact 211 is attached to a lower end of each of fixed terminals 21. Each of fixed contacts 211 may be formed integrally with fixed terminal 21.

Movable contactor 22 is formed into a flat plate shape. Movable contactor 22 moves in a direction D1 (up-down direction). Movable contactor 22 extends along direction D2 (right-left direction) orthogonal to direction D1. That is, a longitudinal direction of movable contactor 22 is along the right-left direction. Movable contactor 22 has the plurality of (two in FIG. 2) movable contacts 222. The plurality of movable contacts 222 are provided at both end portions in the right-left direction on an upper surface of movable contactor 22. The plurality of movable contacts 222 correspond to the plurality of fixed contacts 211 one-to-one. Each of movable contacts 222 faces corresponding fixed contact 211. In the present exemplary embodiment, the plurality of movable contacts 222 are integrated with portions other than the plurality of movable contacts 222 in movable contactor 22, but may be separate bodies.

Each of movable contacts 222 moves in direction D1 (up-down direction) and forms either a state in contact with corresponding fixed contact 211 or a state separated from corresponding fixed contact 211. More particularly, electromagnet device 5 generates an electromagnetic force that drives movable contactor 22, and movable contactor 22 is driven, so that each of movable contacts 222 is put into the state in contact with corresponding fixed contact 211 from the state separated from corresponding fixed contact 211. This allows two fixed contacts 211 to be electrically conducted. When electromagnet device 5 does not generate the electromagnetic force, a spring force of return spring 55 included in electromagnet device 5 puts each of movable contacts 222 into the state separated from corresponding fixed contact 211. This puts two fixed contacts 211 into a state not electrically conducted.

A direction in which each of fixed contacts 211 and corresponding movable contact 222 face each other coincides with direction D1 in which movable contactor 22 and each of movable contacts 222 of movable contactor 22 move.

Holder 24 has upper wall 241 and lower wall 242. Upper wall 241 and lower wall 242 face each other in the up-down direction. Movable contactor 22 is passed between upper wall 241 and lower wall 242.

Contact pressure spring 23 is, for example, a compression coil spring. Contact pressure spring 23 is disposed between lower wall 242 of holder 24 and movable contactor 22 in a state where an expansion and contraction direction is directed in the up-down direction. Contact pressure spring 23 applies an upward spring force to movable contactor 22. That is, contact pressure spring 23 applies, to movable contactor 22, a spring force in a direction approaching the plurality of fixed contacts 211.

A shape of drive shaft 25 is a round rod shape. An axial direction of drive shaft 25 is along the up-down direction. An upper end of drive shaft 25 is coupled to holder 24. Drive shaft 25 is connected to movable contactor 22 via holder 24. A lower end of drive shaft 25 is coupled to movable iron core 53 included in electromagnet device 5. Drive shaft 25 moves in the up-down direction as a state of electromagnet device 5 switches between a state where the electromagnetic force is generated and a state where the electromagnetic force is not generated. Along with this, holder 24 moves in the up-down direction, and movable contactor 22 passed through holder 24 moves in the up-down direction. That is, movable contactor 22 moves in the direction (direction D1) in which fixed contacts 211 and movable contacts 222 face each other. In short, drive shaft 25 moves movable contactor 22 in direction D1. Therefore, drive shaft 25 moves movable contactor 22 between the state where each of movable contacts 222 is in contact with corresponding fixed contact 211 and the state where movable contact 222 is separated from corresponding fixed contact 211.

Inner case 41 is formed of a heat-resistant material such as ceramic. A shape of inner case 41 is a box shape with a lower surface open. Two through holes 411 disposed in the right-left direction are formed on the upper surface of inner case 41. A space inside inner case 41 is containing chamber 410 that contains the plurality of fixed contacts 211 and the plurality of movable contacts 222. That is, contact point device 2 includes containing chamber 410.

Containing chamber 410 is filled with an arc-extinguishing gas such as hydrogen, and is sealed. Containing chamber 410 does not have to be sealed and may be connected to an external environment.

A shape of joining body 42 is a rectangular frame shape. Joining body 42 is bonded to inner case 41 by brazing. Further, joining body 42 is bonded to yoke 54 included in electromagnet device 5 by brazing. This allows joining body 42 to be joined to inner case 41 and yoke 54.

Shielding member 3 has electrical insulation. Shielding member 3 is formed of an electrically insulating material such as ceramic or synthetic resin. Shielding member 3 is contained in containing chamber 410. Here, in contact point device 2, when each of movable contacts 222 enters the state separated from corresponding fixed contact 211 from the state in contact with corresponding fixed contact 211, an arc may be generated between movable contact 222 and fixed contact 211. Shielding member 3 shields the arc generated between fixed contact 211 and movable contact 222. Details of a configuration of shielding member 3 will be described later.

Magnetic flux generator 43 has a pair of permanent magnets 431. The pair of permanent magnets 431 is disposed and fixed between an outer surface of inner case 41 and an inner surface of housing 9. The pair of permanent magnets 431 is disposed outside two fixed contacts 211 in the direction in which two fixed contacts 211 are disposed side by side (direction D2). Each of permanent magnets 431 is disposed at a position aligned with movable contactor 22 in direction D2. That is, the pair of permanent magnets 431 faces movable contactor 22 in the longitudinal direction (right-left direction) of movable contactor 22. Here, the situation where the pair of permanent magnets 431 faces movable contactor 22 includes a case where a member such as inner case 41 is disposed between each of permanent magnets 431 and movable contactor 22 as in the present exemplary embodiment. The pair of permanent magnets 431 has different poles facing each other. For example, in FIG. 2, permanent magnet 431 on the right side has a north pole directed to the left, and permanent magnet 431 on the left side has a south pole directed to the right. The pair of permanent magnets 431 generates a magnetic flux directed in direction D2 between each of fixed contacts 211 and corresponding movable contact 222. The magnetic flux directed in direction D2 preferably exists around each of fixed contacts 211 or each of movable contacts 222.

Electromagnetic relay 1 further includes a pair of cross-linking portions 44. The pair of cross-linking portions 44 is formed of a magnetic material. One of the pair of cross-linking portions 44 is disposed on a front side of a paper surface of FIG. 2 when viewed from movable contactor 22, and the other is disposed on a back side of the paper surface of FIG. 2 when viewed from movable contactor 22. The pair of cross-linking portions 44 is disposed, bridging between the pair of permanent magnets 431.

Electromagnet device 5 includes exciting coil 51, coil bobbin 52, movable iron core 53, yoke 54, return spring 55, cylindrical member 56, and bush 57. Further, electromagnet device 5 includes a pair of coil terminals that both ends of exciting coil 51 are connected to. Each of the coil terminals is formed of a conductive material such as copper, and is connected to a lead wire by solder or the like.

Coil bobbin 52 is formed of a resin or the like as a material. Coil bobbin 52 has two flanges 521, 522 and cylindrical portion 523. Exciting coil 51 is wound around cylindrical portion 523. Flange 521 extends outward in a radial direction of cylindrical portion 523 from an upper end of cylindrical portion 523. Flange 521 extends outward in the radial direction of cylindrical portion 523 from a lower end of cylindrical portion 523.

A shape of cylindrical member 56 is a bottomed cylindrical shape with an upper end open. Cylindrical member 56 is contained in cylindrical portion 523 of coil bobbin 52.

Movable iron core 53 is formed of a magnetic material. A shape of movable iron core 53 is cylindrical. Movable iron core 53 is contained in cylindrical member 56. Drive shaft 25 is passed through an inside of movable iron core 53, and movable iron core 53 and drive shaft 25 are joined to each other. Movable iron core 53 is formed with recess 531 that is recessed downward from an upper surface.

Yoke 54 forms at least a part of a magnetic circuit through which a magnetic flux generated in exciting coil 51 passes when exciting coil 51 is energized. Yoke 54 includes plate-shaped first yoke 541 (one yoke), plate-shaped second yoke 542, and a pair of plate-shaped third yokes 543. First yoke 541 is disposed between movable contactor 22 and exciting coil 51. First yoke 541 is in contact with an upper surface of coil bobbin 52. Second yoke 542 is in contact with a lower surface of coil bobbin 52. The pair of third yokes 543 extends from right and left ends of second yoke 542 to first yoke 541. A shape of first yoke 541 is a rectangular plate shape. Insertion hole 544 is formed in a substantially center of first yoke 541. Drive shaft 25 is passed through insertion hole 544.

Return spring 55 is, for example, a compression coil spring. A first end of return spring 55 in an expansion and contraction direction (up-down direction) is in contact with first yoke 541, and a second end is in contact with a bottom surface of recess 531 of movable iron core 53. Return spring 55 applies a spring force to movable iron core 53 to move movable iron core 53 downward.

Bush 57 is formed of a magnetic material. A shape of bush 57 is cylindrical. Bush 57 is disposed between an inner peripheral surface of coil bobbin 52 and an outer peripheral surface of cylindrical member 56. Bush 57, together with first to third yokes 541 to 543 and movable iron core 53, forms the magnetic circuit through which the magnetic flux generated when exciting coil 51 is energized passes.

When exciting coil 51 is energized, the magnetic flux generated by exciting coil 51 passes through the magnetic circuit, so that movable iron core 53 moves to make a magnetic resistance of the magnetic circuit smaller. Specifically, when exciting coil 51 is energized, movable iron core 53 moves upward to fill a gap between first yoke 541 and the upper end of movable iron core 53 in the magnetic circuit. More particularly, the electromagnetic force that moves movable iron core 53 upward exceeds the force (spring force) by return spring 55 pushing movable iron core 53 downward, so that movable iron core 53 moves upward. As a result, movable contactor 22 moves upward, and each of movable contacts 222 enters the state in contact with corresponding fixed contact 211. That is, movable contactor 22 moves above the position in FIG. 2 together with holder 24, drive shaft 25, and movable iron core 53.

When exciting coil 51 enters a state not energized from a state energized, the electromagnetic force that moves movable iron core 53 upward disappears, so that movable iron core 53 moves downward due to the spring force of return spring 55. As a result, movable contactor 22 moves downward, and each movable contact 222 enters the state separated from corresponding fixed contact 211 (position shown in FIG. 2).

Next, shielding member 3 will be described in detail with reference to FIG. 1.

Figure 1:
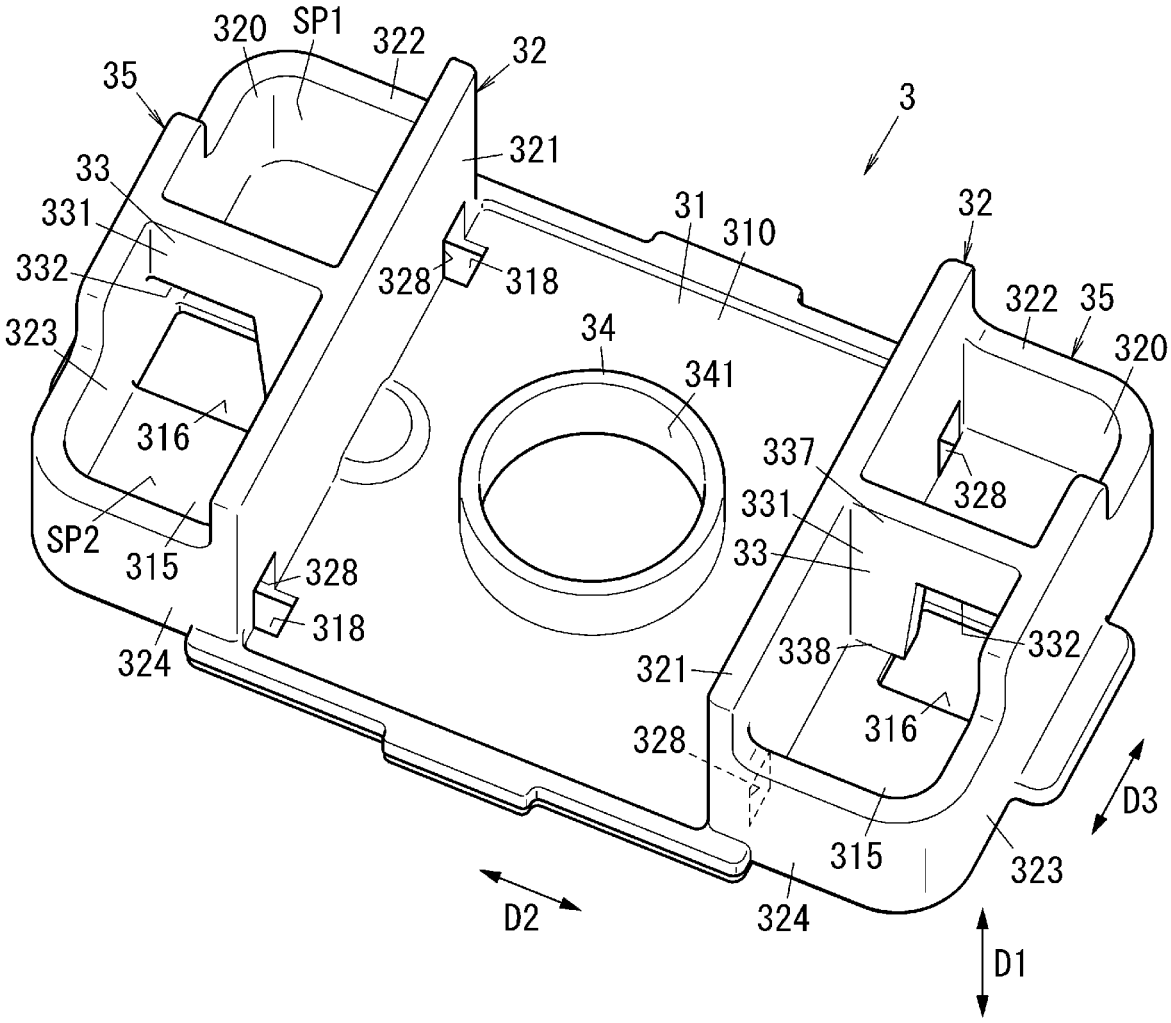
FIG. 1 is a perspective view of a shielding member of an electromagnetic relay according to one exemplary embodiment.

As shown in FIG. 1, shielding member 3 has base 31, a plurality of (two in FIG. 1) side walls 32, and a plurality of (two in FIG. 1) partition walls 33. Further, contact point device 2 includes wall portion 34. Wall portion 34 is integrally formed with shielding member 3.

A shape of base 31 is a rectangular plate shape. A longitudinal direction of base 31 is along the longitudinal direction (right-left direction) of movable contactor 22. A thickness direction of base 31 is along direction D1 (up-down direction). Here, the longitudinal direction of movable contactor 22 is along direction D2. That is, movable contactor 22 extends in direction D2. Direction D2 is orthogonal to direction D1. The thickness direction of base 31 is along a thickness direction of first yoke 541 (see FIG. 2), and base 31 is in contact with first yoke 541. Base 31 (cover) is disposed between first yoke 541 and movable contactor 22, and covers first yoke 541. Further, base 31 has electrical insulation.

The plurality (two) of side walls 32 protrude from one surface 310 (upper surface) of base 31 in the thickness direction of base 31. That is, side walls 32 protrude upward from upper surface 310 of base 31. A shape of each of side walls 32 is tubular. A part of a lower opening of side wall 32 is covered with a plate-shaped bottom wall 315 (described later). One of side wall 32 is provided on one side (left side) of base 31 in the longitudinal direction, and other side wall 32 is provided on the other side (right side) of base 31 in the longitudinal direction. Here, the longitudinal direction of base 31 coincides with direction D2.

An axial direction of tubular wall portion 34 is along the thickness direction of base 31. Here, the thickness direction of base 31 coincides with direction D1. Wall portion 34 is disposed between two side walls 32. As shown in FIG. 1, drive shaft 25 (see FIG. 2) is passed through hole 341 surrounded by wall portion 34 and formed through base 31.

In the following, unless otherwise specified, a description will focus on one side wall 32 of two side walls 32, but other side wall 32 also has the same configuration.

Side wall 32 includes first side wall 321, second side wall 322, third side wall 323, and fourth side wall 324. First side wall 321 and third side wall 323 face each other. Second side wall 322 and fourth side wall 324 face each other. Second side wall 322 and fourth side wall 324 connect first side wall 321 and third side wall 323. When viewed in the thickness direction of base 31 (direction D1), a shape of side wall 32 is a substantially rectangular shape having first side wall 321, second side wall 322, third side wall 323, and fourth side wall 324 as four sides.

In the present exemplary embodiment, a corner formed by second side wall 322 and third side wall 323 is rounded. Similarly, a corner formed by third side wall 323 and fourth side wall 324 is also rounded.

Side wall 32 extends in the direction (direction D1) in which fixed contact 211 and movable contact 222 face each other. Specifically, side wall 32 has a plurality of surfaces along direction D1. More particularly, in each of first side wall 321, second side wall 322, third side wall 323, and fourth side wall 324, surfaces on both sides in the thickness direction are along direction D1.

An internal space of side wall 32 (that is, a space surrounded by first side wall 321, second side wall 322, third side wall 323, and fourth side wall 324) is a shielded chamber that the arc generated between fixed contact 211 and movable contact 222 can enter. That is, the shielded chamber is extension space 320 where the arc can be extended. Each of partition wall 33, first side wall 321, second side wall 322, third side wall 323, and fourth side wall 324 is a part of shielding wall 35 that shields the arc, and faces extension space 320. Shielding wall 35 is disposed inside containing chamber 410. Inside containing chamber 410, first side wall 321, second side wall 322, third side wall 323, and fourth side wall 324 of side wall 32 surround extension space 320. First side wall 321, second side wall 322, third side wall 323, and fourth side wall 324 form a boundary between an inside and an outside of extension space 320. The arc is extended toward extension space 320, so that an arc voltage increases. Increasing the arc voltage makes it easier for the arc to release energy and reduces time required for extinction of the arc. In addition, magnitudes of a current and a voltage that can be shielded in contact point device 2 increase.

Since contact point device 2 is provided with two side walls 32, contact point device 2 is also provided with two extension spaces 320. Two extension spaces 320 correspond to two fixed contacts 211 one-to-one, and correspond to two movable contacts 222 one-to-one. Unless otherwise specified, a relationship between one of two extension spaces 320, and fixed contact 211 and movable contact 222 corresponding to one extension space 320 will be described below. However, a relationship between other extension space 320, and fixed contact 211 and movable contact 222 corresponding to other extension space 320 is also similar.

Figure 3:
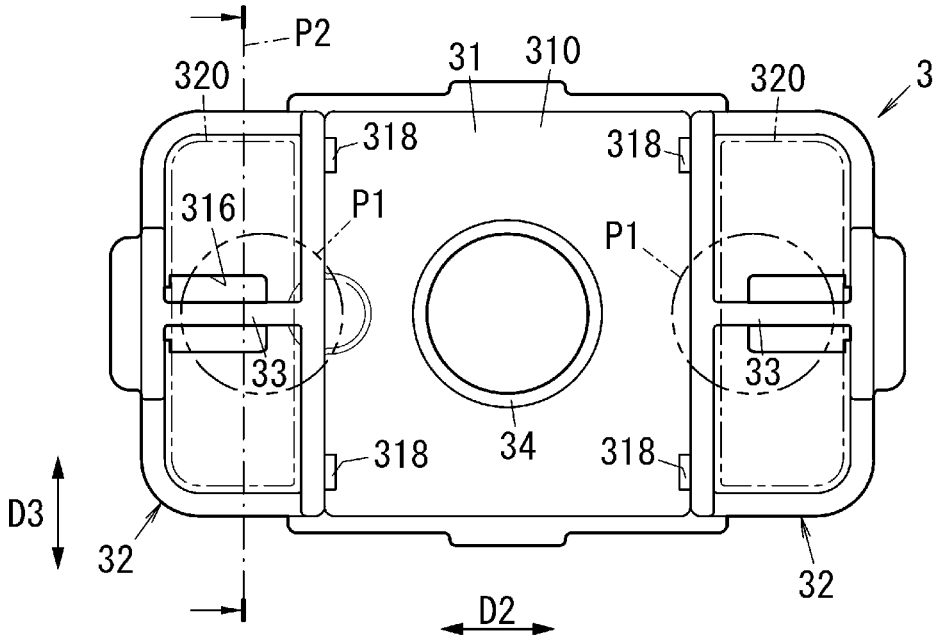
FIG. 3 is a plan view of the shielding member of the same electromagnetic relay.

Extension space 320 is provided at a position facing one of fixed contact 211 and movable contact 222 in the direction (direction D1) in which fixed contact 211 and movable contact 222 face each other. Extension space 320 is provided in a region on a side opposite to a side where the other contact (here, fixed contact 211) is located with respect to one of fixed contact 211 and movable contact 222 (here, movable contact 222). FIG. 3 illustrates a state where fixed contacts 211 are projected onto projection surfaces P1 with the-up-down direction (direction D1: see FIG. 2) as a normal line. Extension spaces 320 are provided at positions overlapping projection surfaces P1.

Partition wall 33 has electrical insulation. Partition wall 33 has a plate shape. Partition wall 33 is disposed in extension space 320, and divides extension space 320 into a plurality of spaces (first space SP1 and second space SP2). Partition wall 33 is a part of shielding wall 35 that shields the arc. Partition wall 33 is disposed at a center of extension space 320. Partition wall 33 is disposed at a position overlapping each of projection surfaces P1. That is, partition wall 33 is disposed at a position overlapping fixed contact 211 when viewed in direction D1. Shielding wall 35 and partition wall 33 of shielding wall 35 are disposed in a region on the side opposite (lower side of movable contact 222) to the side where the other (here, fixed contact 211) is located (upper side of movable contact 222) with respect to any one of fixed contact 211 and movable contact 222 (here, movable contact 222).

More particularly, partition wall 33 is located below movable contactor 22. Partition wall 33 is formed to bridge first side wall 321 and third side wall 323. That is, partition wall 33 extends along direction D2 when viewed in direction D1. Further, partition wall 33 is connected to base 31. A thickness direction of partition wall 33 is along direction D3. Direction D3 is a direction orthogonal to first direction D1 and direction D2. Partition wall 33 has surface 331 along the direction (direction D1) in which fixed contact 211 and movable contact 222 face each other. Partition wall 33 divides between first space SP1 and second space SP2 inside containing chamber 410 in direction D3 when viewed in direction D2. More particularly, partition wall 33 divides extension space 320 into two spaces. That is, partition wall 33 divides extension space 320 into first space SP1 between partition wall 33 and second side wall 322 and second space SP2 between partition wall 33 and fourth side wall 324 (see FIG. 1). Therefore, extension space 320 includes first space SP1 and second space SP2. At least one of first space SP1 and second space SP2 is at least a part of extension space 320 where the arc can be extended.

Partition wall 33 is formed with through hole 332 that penetrates partition wall 33 in a direction intersecting with direction D1. Specifically, through hole 332 penetrates partition wall 33 in direction D3 orthogonal to direction D1. First space SP1 and second space SP2 are connected by through hole 332. Partition wall 33 has first end 337 (upper end) and second end 338 (lower end) in the direction (direction D1) in which fixed contact 211 and movable contact 222 face each other. In partition wall 33, through hole 332 is formed in second end 338 of first end 337 and second end 338, which is located on a side farther from fixed contact 211. In other words, through hole 332 is provided at a lower (in the first direction) end portion of partition wall 33.

In shielding member 3, side wall 32 and bottom wall 315 form an outer wall of extension space 320. Bottom wall 315 is a part of base 31. Side wall 32 and bottom wall 315 divide containing chamber 410 (see FIG. 4) into extension space 320 and an external space adjacent to extension space 320. Bottom wall 315 faces extension space 320 in direction D1. That is, bottom wall 315 faces first space SP1 and second space SP2. Bottom wall 315 covers a lower opening of tubular side wall 32. A thickness direction of bottom wall 315 is along the direction in which fixed contact 211 and movable contact 222 face each other (direction D1).

Extension space 320 is a space between movable contact 222 and bottom wall 315. Partition wall 33 is disposed in extension space 320. That is, partition wall 33 of shielding wall 35 is disposed between movable contact 222 and bottom wall 315 when viewed in direction D2. Bottom wall 315 and shielding wall 35 are connected. Partition wall 33 of shielding wall 35 protrudes in the thickness direction (upward) from bottom wall 315. Side wall 32 of shielding wall 35 protrudes from a peripheral edge of bottom wall 315 in the thickness direction (upward) of bottom wall 315. That is, side wall 32 protrudes from the peripheral edge of bottom wall 315 along the direction in which fixed contact 211 and movable contact 222 face each other (direction D1).

Passage hole 316 is formed in bottom wall 315. Passage hole 316 is a through hole that penetrates bottom wall 315 in direction D1 (the thickness direction of bottom wall 315). Passage hole 316 is provided at a position overlapping partition wall 33 in bottom wall 315 when viewed in direction D1. Passage hole 316 in bottom wall 315 is connected to through hole 332 in partition wall 33 of shielding wall 35. Passage hole 316 is covered with first yoke 541 (see FIG. 2).

In the present exemplary embodiment, through hole 332 is formed by partition wall 33 having a cutout in the lower end portion.

Passage hole 316 is formed at a position straddling first space SP1 and second space SP2 of extension space 320. Therefore, first space SP1 and second space SP2 are connected through passage hole 316. As mentioned above, passage hole 316 is covered with first yoke 541 (see FIG. 2). However, passage hole 316 forms a space at least as thick as bottom wall 315 between first space SP1 and second space SP2. Therefore, passage hole 316 contributes to movement of gas between first space SP1 and second space SP2.

A plurality of (two in FIG. 1) through holes 328 are formed in first side wall 321 of side wall 32. Through holes 328 in first side wall 321 penetrate in the direction intersecting with direction D1. Particularly, through holes 328 penetrate in direction D2 orthogonal to direction D1. One of through holes 328 is connected to first space SP1 of extension space 320, and other through hole 328 is connected to second space SP2 of extension space 320. First space SP1 and second space SP2 of extension space 320 are connected to the outside of extension space 320 by the plurality of through holes 328. More particularly, first space SP1 and second space SP2 are connected, by the plurality of through holes 328, to a space where tubular wall portion 34 is disposed.

Base 31 is formed with a plurality of (four, see FIG. 3) base holes 318. Each of the plurality of base holes 318 penetrates base 31 in the thickness direction (direction D1) of base 31. The plurality of base holes 318 correspond to two through holes 328 in each of two side walls 32 (i.e., a total of four through holes 328) one-to-one. Each of base holes 318 is connected to corresponding through hole 328. Base 31 may not have base holes 318.

Wall portion 34 is aligned with side walls 32 in the direction (direction D2) orthogonal to the direction in which fixed contacts 211 and movable contacts 222 face each other (direction D1). Wall portion 34 surrounds drive shaft 25 (see FIG. 2) in containing chamber 410. When foreign matter is scattered due to an air flow or the like generated by the arc, it is difficult for the foreign matter to intrude a side of drive shaft 25 beyond wall portion 34, so that driving of drive shaft 25 can be prevented from being hindered by the intrusion of the foreign matter.

Figure 4:
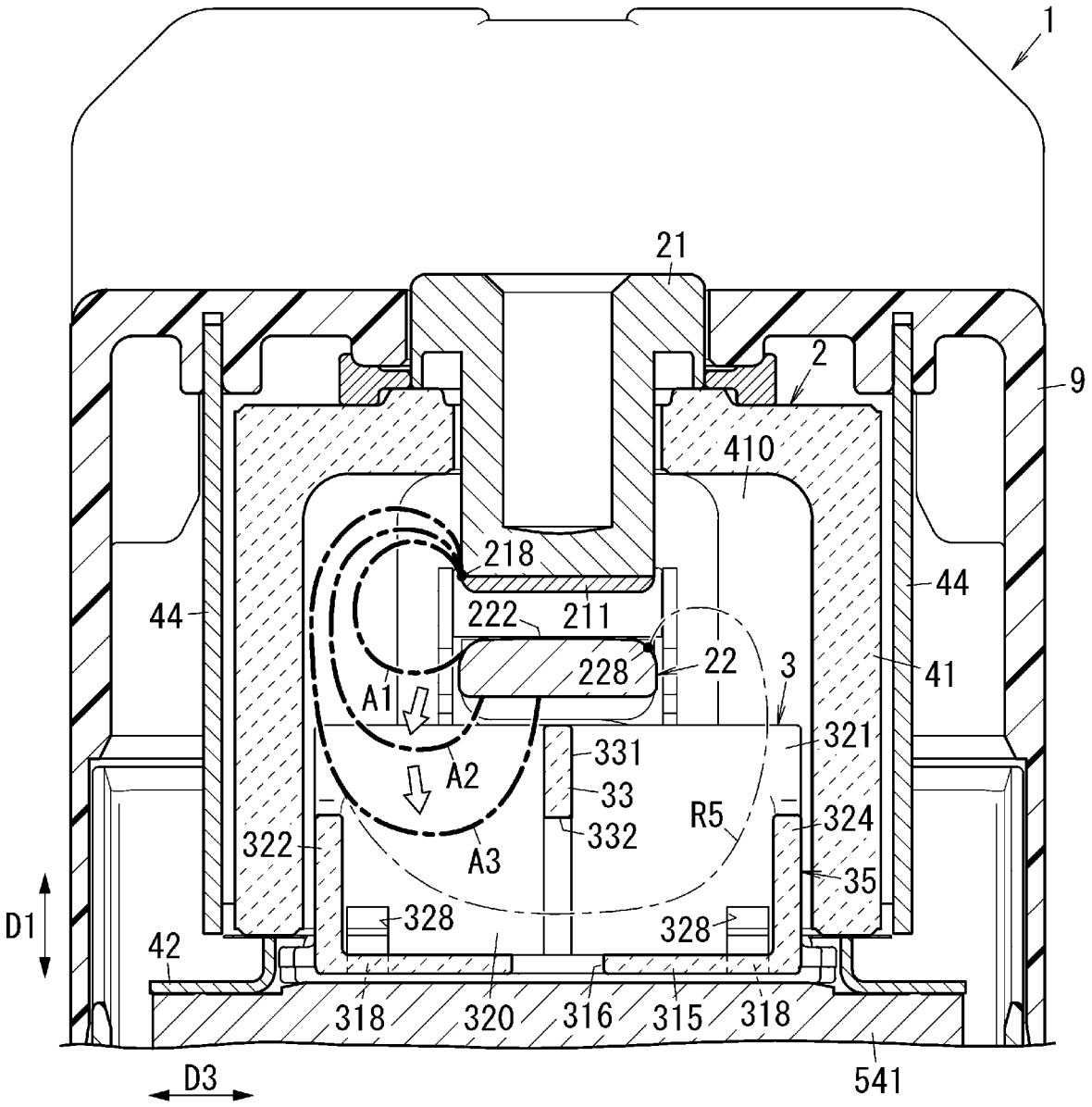
FIG. 4 is a cross-sectional view of the same electromagnetic relay as viewed from the side.

FIG. 4 is a cross-sectional view of electromagnetic relay 1 along a plane (hereinafter referred to as plane P2. See FIG. 3) along the direction (direction D1) in which fixed contact 211 and movable contact 222 face each other. In FIG. 4, virtual route R5 is a route inside containing chamber 410 and is a route on plane P2. Virtual route R5 goes around movable contact 222 on plane P2 to connect fixed contact 211 and movable contact 222. Virtual route R5 is a route that bypasses outside a space between fixed contact 211 and movable contact 222. Virtual route R5 may go around fixed contact 211 instead of movable contact 222 to connect fixed contact 211 and movable contact 222. This virtual route R5 exemplifies a route followed by the arc generated between fixed contact 211 and movable contact 222 when partition wall 33 is not disposed in extension space 320. Virtual route R5 connects one end 218 of fixed contact 211 in direction D3 (an end on the left side of a paper surface in FIG. 4) and one end 228 of movable contact 222 on a side opposite to a side where one end 218 of fixed contact 211 is located in direction D3 (an end on the right side of the paper surface in FIG. 4). Here, direction D3 is a direction orthogonal to direction D1 and direction D2. Direction D2 is a direction that intersects with plane P2 running along direction D1.

One end 218 of fixed contact 211 in direction D3 is, for example, a region of a surface of fixed contact 211 whose normal direction is along the left direction. That is, one end 218 of fixed contact 211 in direction D3 corresponds not only to a point located at a most end (here, the left end in this case) on the surface of fixed contact 211, but also to the region including this point. One end 228 of movable contact 222 is, as one example, a region of a surface of movable contact 222 whose normal direction is along the right direction. That is, one end 228 of movable contact 222 in direction D3 corresponds not only to a point located at a most end (here, the right end) on the surface of movable contact 222, but also to the region including this point.

Partition wall 33 is disposed on virtual route R5. Specifically, partition wall 33 has a plate shape, and the thickness direction of partition wall 33 is a direction (direction D3) along plane P2 along direction D1. Partition wall 33 extends in a direction orthogonal to plane P2.

The magnetic flux generated by the pair of permanent magnets 431 (see FIG. 2) of magnetic flux generator 43 (see FIG. 2) intersects with plane P2. That is, the pair of permanent magnets 431 generates, around fixed contact 211, the magnetic flux intersecting with plane P2. In short, between fixed contact 211 and movable contact 222, the direction of the magnetic flux is direction D2 (a depth direction of the paper surface in FIG. 4). The pair of permanent magnets 431 faces movable contactor 22 in the direction intersecting with plane P2 (direction D2).

Figure 5:
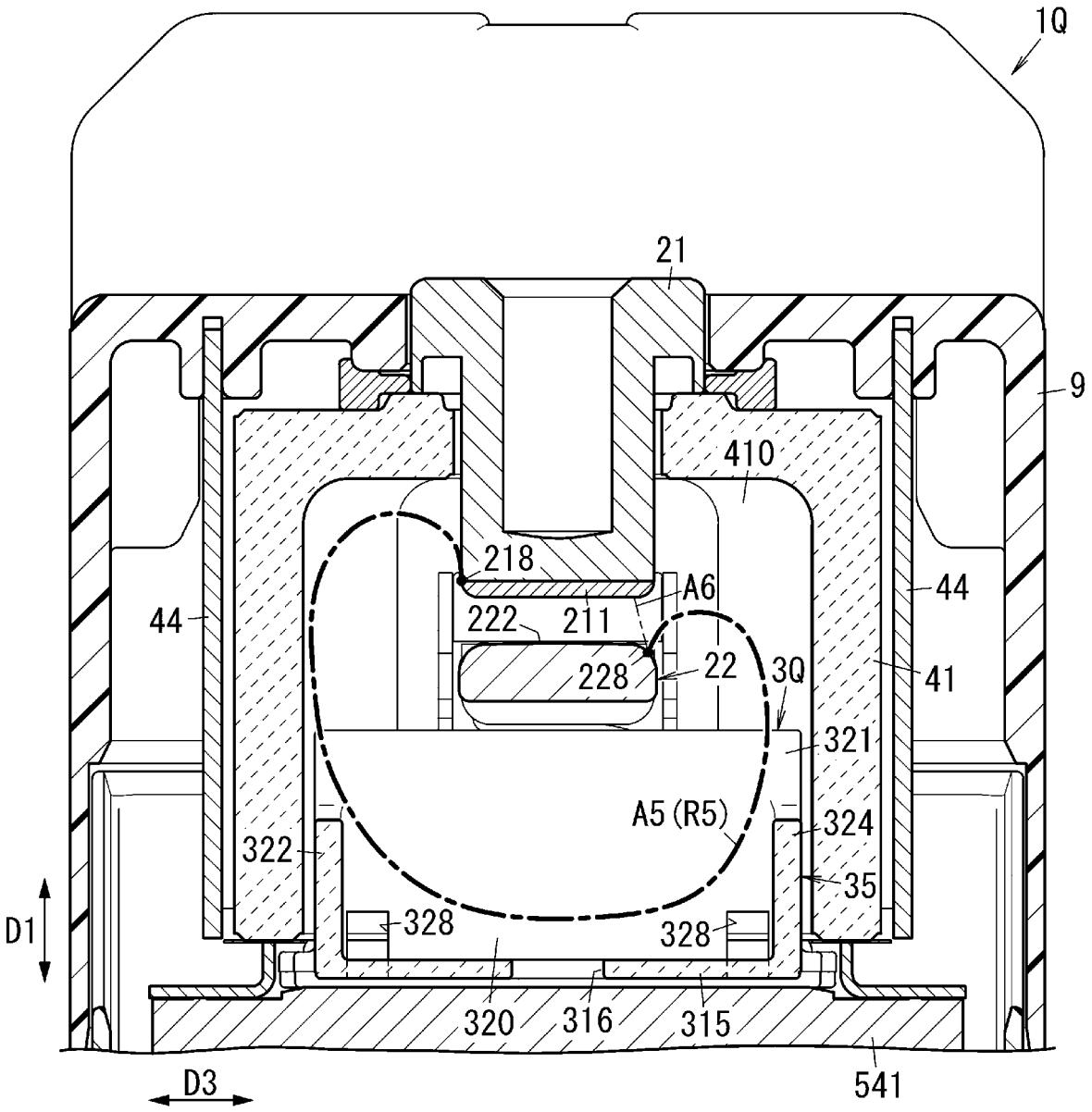
FIG. 5 is a cross-sectional view of an electromagnetic relay according to a comparative example with the one exemplary embodiment as viewed from the side.

Next, one example of arc behavior when the arc is generated between fixed contact 211 and movable contact 222 in containing chamber 410 will be described with reference to FIGS. 4, 5. In FIG. 4, alternate long and short dash lines A1 to A3 virtually represent movement routes of the generated arc. Similarly, in FIG. 5, alternate long and short dash lines A5, A6 virtually represent movement routes of the generated arc. FIG. 5 is a view showing electromagnetic relay 1Q as a comparative example with electromagnetic relay 1 of the exemplary embodiment. Electromagnetic relay 1Q differs from electromagnetic relay 1 of the exemplary embodiment in that electromagnetic relay 1Q includes, instead of shielding member 3, shielding member 3Q that does not have partition wall 33.

In FIG. 4, the arc moves due to Lorentz force. That is, the magnetic flux generated by the pair of permanent magnets 431 (see FIG. 2) of magnetic flux generator 43 (see FIG. 2) is along direction D2. Since a direction of a current in the arc is approximately along direction D1, the Lorentz force in direction D3 (toward the left of the paper surface in FIG. 4) orthogonal to direction D1 and direction D2 acts on the arc extending in direction D1.

The arc is extended by the Lorentz force. White arrows shown in FIG. 4 represent a process in which the arc is extended. That is, the generated arc is extended from a position indicated by alternate long and short dash line A1 to a position indicated by alternate long and short dash line A3 via a position indicated by alternate long and short dash line A2 inside containing chamber 410. By being extended in this way, the arc reaches extension space 320.

Here, since partition wall 33 is disposed in extension space 320, it is difficult for the arc to move beyond partition wall 33 from first space SP1 to second space SP2. Therefore, as compared with a case without partition wall 33, a possibility is higher that a state is maintained where the arc is extended on a front side of partition wall 33 (on the left side of the paper surface in FIG. 4) (in other words, stays in first space SP1) in extension space 320.

If partition wall 33 is not disposed in extension space 320 as shown in FIG. 5, the arc may be further extended and go around movable contactor 22 as indicated by alternate long and short dash line A5. Then, there is a higher possibility that the extended arc reaches one end 228 of movable contact 222 on the side opposite to the side where one end 218 of fixed contact 211 is located in direction D3. When the arc reaches one end 228 of movable contactor 22, the arc may transfer to a position that linearly connects fixed contact 211 and movable contact 222 (see alternate long and short dash line A6 in FIG. 5). That is, the extended arc indicated by alternate long and short dash line A5 can return to an arc having a shorter length. When such a relatively short arc is generated, there is a possibility that the arc voltage decreases, that the time required for extinguishing the arc increases or the like, and that arc extinguishing performance of electromagnetic relay 1Q deteriorates.

In electromagnetic relay 1 of the present exemplary embodiment, as indicated by alternate long and short dash line A3 in FIG. 4, it is easy to maintain the arc in the extended state without transferring the arc. Therefore, electromagnetic relay 1 of the present exemplary embodiment has higher arc extinguishing performance than electromagnetic relay 1Q according to the comparative example.

Next, a function of through hole 332 formed in partition wall 33 will be described with reference to FIGS. 6, 7A, 7B. In order to make it easier to compare electromagnetic relay 1R shown in FIG. 6 with electromagnetic relay 1S shown in FIGS. 7A, 7B, in electromagnetic relays 1R, 1S, through holes 328 (see FIG. 4) are not formed in first side walls 321R, 321S of shielding members 3R, 3S, and passage holes 316 are not formed in bottom walls 315R, 315S. In electromagnetic relay 1R shown in FIG. 6, through hole 332 is formed in partition wall 33. On the other hand, in electromagnetic relay 1S shown in FIGS. 7A, 7B, through hole 332 is not formed in partition wall 33S.

Figure 6:
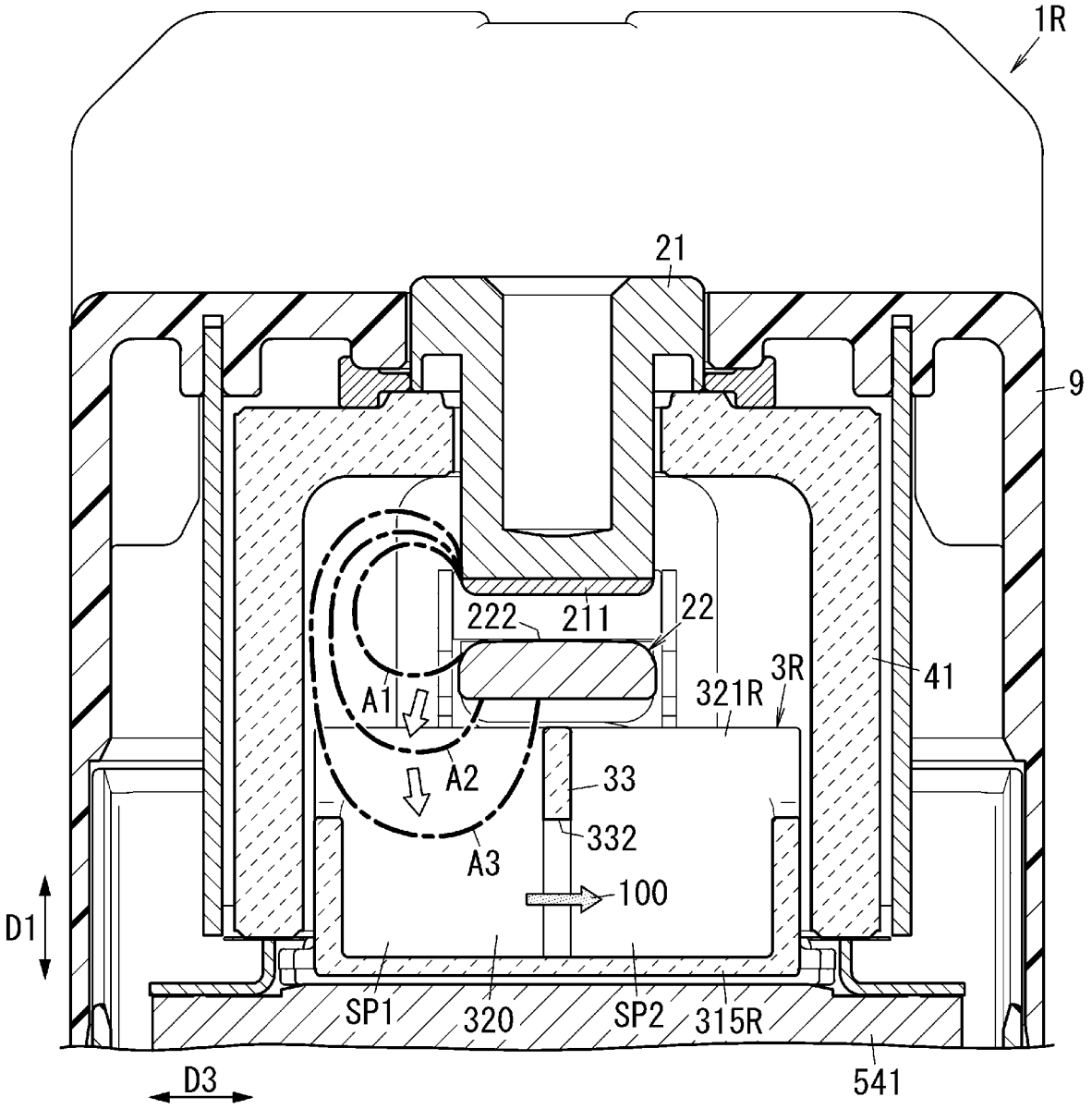
FIG. 6 is an explanatory view of arc behavior in the electromagnetic relay according to the one exemplary embodiment.

In electromagnetic relay 1R shown in FIG. 6, the arc generated between fixed contact 211 and movable contact 222 passes the positions indicated by alternate long and short dash lines A1, A2, A3 as indicated by the white arrows in FIG. 6, and extends to first space SP1 of extension space 320. Here, there is a possibility that the arc generates an air flow of gas in containing chamber 410. The air flow generated in first space SP1 of extension space 320 easily flows to second space SP2 through hole 332 as indicated by arrow 100. Therefore, in the arc, the air flow generated in first space SP1 is hard to be pushed back to the side of fixed contact 211, and the extended state is easily maintained as indicated by alternate long and short dash line A3.

Figure 7A:
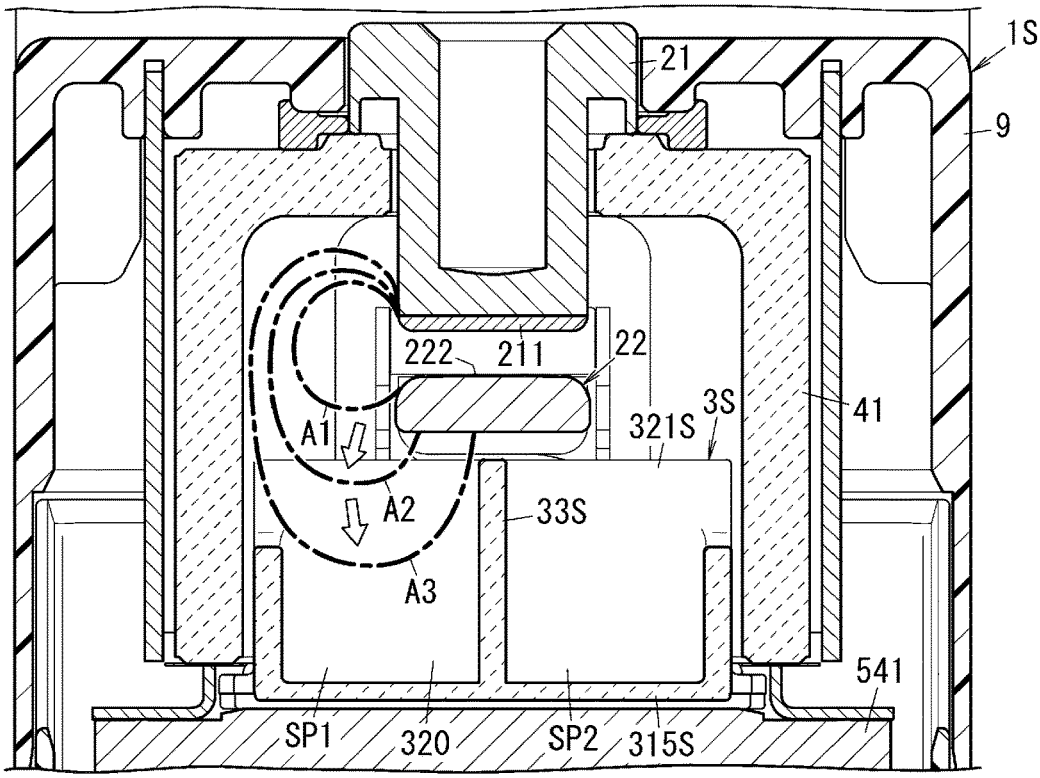
FIG. 7A is an explanatory view of arc behavior in an electromagnetic relay according to a comparative example with the one exemplary embodiment.
Figure 7B:
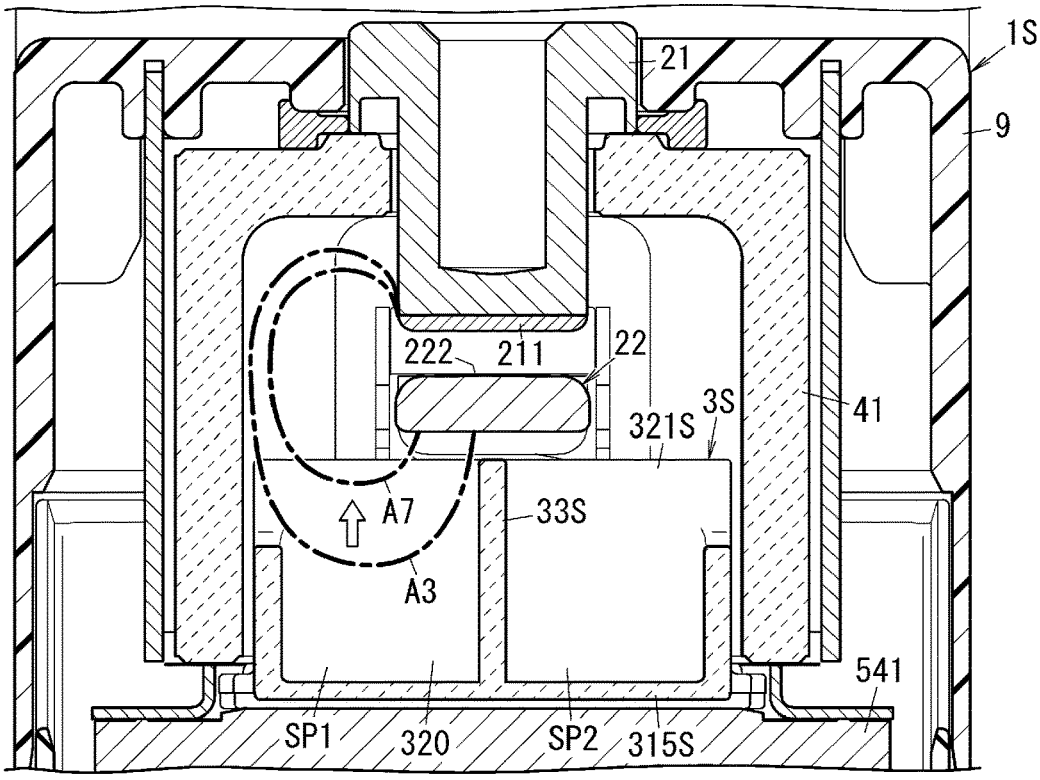
FIG. 7B is an explanatory diagram of arc behavior in the electromagnetic relay according to the comparative example with the one exemplary embodiment.

On the other hand, in electromagnetic relay 1S shown in FIG. 7A, as in electromagnetic relay 1R shown in FIG. 6, the arc generated between fixed contact 211 and movable contact 222 passes the positions indicated by alternate long and short dash lines A1, A2, A3, and is extended to first space SP1 of extension space 320 (see white arrows in FIG. 7A). Here, when an air flow is generated by the arc, the arc may be pushed back to the side where fixed contact 211 and movable contact 222 are located by a pressure of the air flow, as indicated by a white arrow in FIG. 7B, and an arc length may be relatively short as indicated by alternate long and short dash line A7. Therefore, it is difficult for the arc to be maintained in the extended state inside extension space 320 as compared with electromagnetic relay 1R shown in FIG. 6.

In electromagnetic relay 1 according to the present exemplary embodiment shown in FIG. 4, the air flow generated in extension space 320 can flow out through the plurality of through holes 328 in side wall 32 and passage hole 316 in bottom wall 315. Therefore, it is possible to reduce the possibility that the arc that has moved from a vicinity of fixed contact 211 to extension space 320 is pushed back to the side of fixed contact 211 by the air flow. As a result, the arc is more easily extended than the case where the plurality of through holes 328 and passage hole 316 do not exist, so that the arc extinguishing performance of electromagnetic relay 1 is improved. Further, the air flow generated in extension space 320 can also flow out through hole 332 in partition wall 33. Therefore, the possibility that the arc is pushed back to the side of fixed contact 211 by the air flow can be further reduced.

Further, in the present exemplary embodiment, it is assumed that a current flows through movable contactor 22 from left to right. When the direction of the current flowing through movable contactor 22 is opposite to that of the present exemplary embodiment, a direction of the Lorentz force acting on the arc is opposite, so that the arc is extended to the right side of the paper surface in FIG. 4. In this case, similarly to the present exemplary embodiment, the movement of the arc can also be restricted by partition wall 33, and the state where the arc is extended can be maintained. That is, first space SP1 and second space SP2 divided by partition wall 33 can be used as extension spaces where the arc can be extended. Electromagnetic relay 1 can be used as a bipolar electromagnetic relay having an arbitrary direction of a current flow. Here, a shape of shielding member 3 is line-symmetrical in direction D3 (right-left direction of the paper surface in FIG. 4). Therefore, electromagnetic relay 1 can exhibit the similar performance regardless of the direction in which the current flows.

(First Modification of the Exemplary Embodiment)

Figure 8:
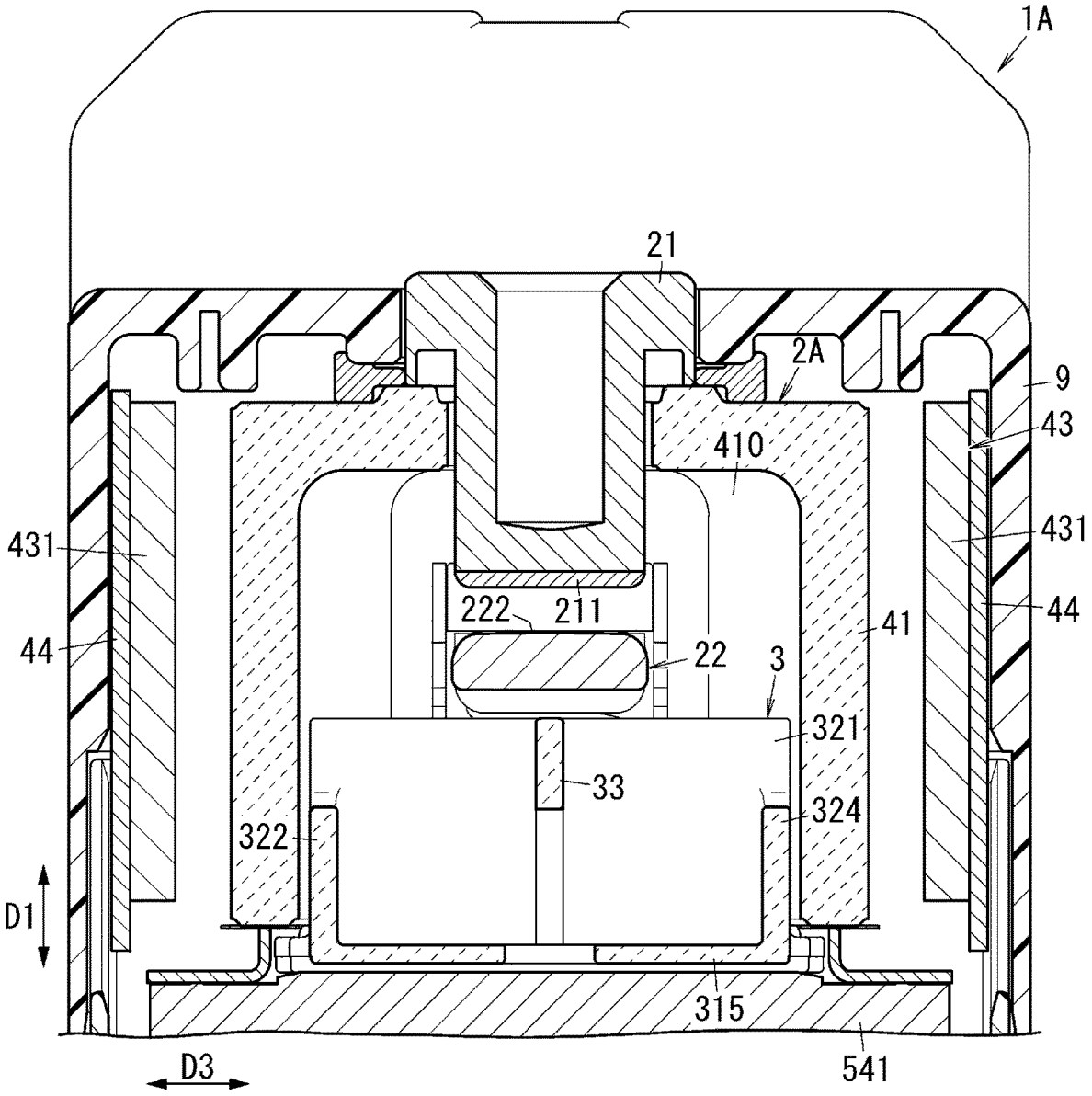
FIG. 8 is a cross-sectional view of the electromagnetic relay according to a first modification of the one exemplary embodiment as viewed from the side.

Next, a first modification of the exemplary embodiment will be described with reference to FIG. 8. Similar components as those in the exemplary embodiment are designated by the same reference numerals, and description thereof will be omitted.

In electromagnetic relay 1A and contact point device 2A of the present modification, disposition of the pair of permanent magnets 431 is different from the disposition in the exemplary embodiment. The pair of permanent magnets 431 is disposed on both sides of movable contactor 22 in direction D3. That is, permanent magnets 431 are disposed at positions aligned with movable contactor 22 in direction D3. More particularly, the pair of permanent magnets 431 is disposed and fixed between the outer surface of inner case 41 and the inner surface of housing 9.

The pair of permanent magnets 431 has the same poles facing each other. For example, in FIG. 8, permanent magnet 431 on the right side of the paper surface has a north pole facing left, and permanent magnet 431 on the left side of the paper surface has a north pole facing right. The pair of permanent magnets 431 generates a magnetic flux around fixed contact 211 that intersects with plane P2 along direction D1 (plane substantially parallel to the paper surface of FIG. 8). More particularly, the pair of permanent magnets 431 generates, around fixed contact 211, the magnetic flux along the longitudinal direction of movable contactor 22 (a depth direction of the paper surface in FIG. 8).

In this modification, the direction of the magnetic flux around fixed contact 211 is the same as that of the exemplary embodiment, so that the arc generated between fixed contact 211 and movable contact 222 is extended similarly to the exemplary embodiment.

(Other Modifications of the Exemplary Embodiment)

Next, other modifications of the exemplary embodiment are listed. The following modifications may be achieved in appropriate combinations. Further, the following modifications may be achieved in combination with the first modification of the exemplary embodiment as appropriate.

It is not essential that shielding member 3 is provided with through hole 332 and through hole 328. In shielding member 3, extension space 320 may be at least open upward. That is, extension space 320 may be open at least on the side where fixed contact 211 and movable contact 222 are located.

Further, the direction in which through hole 328 penetrates side wall 32 is not limited to direction D2, and may be, for example, direction D3. Further, through hole 328 is not limited to being formed only on first side wall 321, and through hole 328 may be formed on at least one of first side wall 321, second side wall 322, third side wall 323, and fourth side wall 324.

Further, it is not essential that shielding member 3 is provided with passage hole 316.

Further, passage hole 316 may be covered with an insulating sheet having electrically insulation. That is, the insulating sheet may be sandwiched between shielding member 3 and yoke 54. In this case, a possibility that the arc reaches yoke 54 can be reduced.

Further, shielding member 3 may have a conductive material such as, for example, metal. That is, at least a part of shielding member 3 may have conductivity.

Further, shielding member 3 may be provided with a member having a shape different from the shape of partition wall 33 instead of partition wall 33. That is, a function of partition wall 33 in the exemplary embodiment is to limit the movement of the arc that has entered extension space 320, and a member for limiting the movement of the arc is not limited to the wall-shaped member such as partition wall 33, but a member having a different shape can be adopted. For example, instead of partition wall 33, a rod-shaped member may be provided, bridging between first side wall 321 and third side wall 323.

Further, shielding member 3 may be provided with a cover member that covers second space SP2 of extension space 320 from above instead of partition wall 33. In this case, it is possible to reduce the possibility that the arc entering first space SP1 passes through second space SP2 and then moves beyond the cover member to one end 228 of movable contact 222. Further, shielding member 3 may be provided with a cover member in addition to partition wall 33. Further, the cover member may be formed with a through hole. Further, the cover member may cover first space SP1 from above instead of covering second space SP2 from above.

Further, in the exemplary embodiment, extension space 320 is divided into first space SP1 and second space SP2 by partition wall 33, but one of first space SP1 and second space SP2 may not be hollow. For example, a portion corresponding to second space SP2 may be filled with a resin. Even in this case, at least for the arc entering first space SP1, the possibility that the state where the arc is extended is maintained can be increased.

Further, it is not essential that housing 9 containing contact point device 2 and electromagnet device 5 has airtightness.

Further, a number of each of fixed contacts 211 and movable contacts 222 is not limited to two, and may be one, or equal to or more than three.

Further, when permanent magnet 431 faces movable contactor 22 in the longitudinal direction of movable contactor 22, a number of permanent magnets 431 may be one. That is, permanent magnet 431 may be disposed only on one end side of both ends of movable contactor 22 in the longitudinal direction.

Further, the number of permanent magnets 431 is not limited to one or two, but may be equal to or more than three.

CONCLUSION

From the exemplary embodiment described above and the like, the following aspects are disclosed.

Contact point device 2 (or 2A) according to one aspect includes fixed contact 211, movable contactor 22 that has movable contact 222 capable of being in contact with fixed contact 211 by moving in parallel with direction D1, and extends along direction D2 orthogonal to direction D1, containing chamber 410 that contains fixed contact 211 and movable contact 222, and shielding wall 35 disposed inside containing chamber 410. Containing chamber 410 has first space SP1 and second space SP2, shielding wall 35 faces first space SP1 or second space SP2, and shielding wall 35 includes partition wall 33 located between first space SP1 and second space SP2. First space SP1 and second space SP2 are disposed side by side in direction D3 orthogonal to direction D1 and direction D2. Partition wall 33 is located below fixed contact 211 and movable contact 222.

According to the above configuration, when the arc generated between fixed contact 211 and movable contact 222 is extended, the extension of the arc can be shielded by partition wall 33. Therefore, the possibility that the extended arc returns to a shorter arc can be reduced. As a result, the possibility that the state where the arc length is long can be maintained is increased. As a result, the state where the arc voltage is relatively large can be maintained, so that the arc extinguishing performance of contact point device 2 (or 2A) is improved.

Further, in contact point device 2 (or 2A) according to another aspect, partition wall 33 extends along direction D2 when viewed in direction D1.

According to the above configuration, the arc can be shielded by the portion of partition wall 33 along direction D2.

Further, in contact point device 2 (or 2A) according to another aspect, at least one of first space SP1 and second space SP2 is at least a part of extension space 320 where the arc can be extended.

According to the above configuration, the arc that has moved to extension space 320 can be shielded by partition wall 33.

Further, contact point device 2 (or 2A) according to another aspect further includes bottom wall 315 that is located below first space SP1 and second space SP2, and faces first space SP1 and second space SP2. Partition wall 33 is located between bottom wall 315 and movable contact 222.

According to the above configuration, since the arc is difficult to move beyond bottom wall 315, the possibility that the arc that has moved to extension space 320 spreads to the outside of extension space 320 can be reduced.

Further, in contact point device 2 (or 2A) according to another aspect, shielding wall 35 has side wall 32. Side wall 32 protrudes upward from a peripheral edge of bottom wall 315.

According to the above configuration, since the arc is difficult to move beyond side wall 32, the possibility that the arc that has moved to extension space 320 spreads to the outside of extension space 320 can be reduced.

Further, contact point device 2 (or 2A) according to another aspect further includes drive shaft 25 and wall portion 34. Drive shaft 25 moves movable contactor 22 in parallel with direction D1. Wall portion 34 has a tubular shape. Wall portion 34 is disposed inside containing chamber 410 and surrounds drive shaft 25.

According to the above configuration, when foreign matter is scattered due to the air flow or the like generated by the arc, it is difficult for the foreign matter to intrude to the side of drive shaft 25 beyond wall portion 34, so that driving of drive shaft 25 can be prevented from being hindered by the intrusion of the foreign matter.

Further, contact point device 2 (or 2A) according to another aspect further includes permanent magnet 431. Permanent magnet 431 generates a magnetic flux directed in direction D2 between fixed contact 211 and movable contact 222.

According to the above configuration, the arc can be extended by the Lorentz force generated by permanent magnet 431.

Further, in contact point device 2 according to another aspect, permanent magnet 431 is disposed at a position aligned with movable contactor 22 in direction D2.

According to the above configuration, the magnetic flux along direction D2 can be generated around movable contactor 22 and the Lorentz force generated by this magnetic flux can be applied to the arc to extend the arc.

Further, in contact point device 2A according to another aspect, permanent magnet 431 is disposed at a position aligned with movable contactor 22 in direction D3.

According to the above configuration, the magnetic flux along direction D2 can be generated around movable contactor 22 and the Lorentz force generated by this magnetic flux can be applied to the arc to extend the arc.

Further, in contact point device 2 (or 2A) according to another aspect, partition wall 33 has electrical insulation.

According to the above configuration, partition wall 33 improves performance to shield the arc as compared with a case where partition wall 33 has electrical conductivity.

Further, in contact point device 2 (or 2A) according to another aspect, at least a part of partition wall 33 overlaps with fixed contact 211 when viewed in direction D1.

According to the above configuration, in both cases where the arc moves in a certain direction toward partition wall 33 and where the arc moves toward partition wall 33 in a direction opposite to the above-mentioned direction when viewed in direction D1, the arc can be shielded by partition wall 33.

Further, contact point device 2 (or 2A) according to another aspect further includes other fixed contact 211. Movable contactor 22 further has other movable contact 222. Other movable contact 222 faces other fixed contact 211.

According to the above configuration, two-point cutting type contact point device 2 (or 2A) can be configured.

Further, electromagnetic relay 1 (or 1A) according to another aspect includes above-mentioned contact point device 2 (or 2A) and electromagnet device 5. Electromagnet device 5 has exciting coil 51.

According to the above configuration, when the arc generated between fixed contact 211 and movable contact 222 is extended, the extension of the arc can be shielded by partition wall 33. Therefore, the possibility that the extended arc returns to a shorter arc can be reduced. As a result, the possibility that the state where the arc length is long can be maintained is increased. Thereby, the state where the arc voltage is a relatively large can be maintained, so that the arc extinguishing performance of contact point device 2 (or 2A) in electromagnetic relay 1 (or 1A) is improved.

Further, in electromagnetic relay 1 (or 1A) according to another aspect, electromagnet device 5 has yoke 54. The magnetic flux generated by exciting coil 51 passes through yoke 54. Yoke 54 includes first yoke 541. First yoke 541 is disposed between movable contactor 22 and exciting coil 51. Contact point device 2 (or 2A) includes a cover (base 31). The cover is disposed between first yoke 541 and movable contactor 22 and covers the first yoke. The cover has electrical insulation.

According to the above configuration, since the arc is difficult to move beyond the cover (base 31), yoke 54 can be protected from the arc.

REFERENCE MARKS IN THE DRAWINGS

1, 1A, 1Q, 1R, 1S electromagnetic relay
2, 2A contact point device
21 fixed terminal
211 fixed contact
218 one end
22 movable contactor
222 movable contact
228 one end
24 holder
241 upper wall
242 lower wall
25 drive shaft
3, 3Q, 3R shielding member
31 base (cover)
32 side wall
33, 33S partition wall
34 wall portion
35 shielding wall
310 one surface (upper side)
315, 315R, 315S bottom wall
316 passage hole
318 base hole
320 extension space
321 first side wall
322 second side wall
323 third side wall
324 fourth side wall
328 through hole
331 surface
332 through hole
337 first end
338 second end
341 through hole
41 inner case
410 containing chamber
411 through hole
42 joining body
43 magnetic flux generator
431 permanent magnet
44 cross-linking portion
5 electromagnet device
51 exciting coil

52 coil bobbin
521 flange
523 cylindrical portion
53 movable iron core
531 recess
54 yoke
541 first yoke (yoke)
542 second yoke
543 third yoke
544 insertion hole
55 return spring
56 cylindrical member
57 bush
9 housing
911 through hole
D1 direction
D2 direction
D3 direction
P1 projection plane
P2 plane
R5 virtual route
SP1 first space (space)
SP2 second space (space)

The invention claimed is:

1. A contact point device comprising:

a first fixed contact;

a movable contactor that has a first movable contact capable of being in contact with the first fixed contact by moving in parallel with a first direction, and extended along a second direction orthogonal to the first direction;

a containing chamber that contains the first fixed contact and the first movable contact; and a shielding wall disposed inside the containing chamber, wherein the containing chamber has a first space and a second space, the shielding wall faces the first space or the second space, the shielding wall includes a partition wall located between the first space and the second space, the first space and the second space are disposed side by side in a third direction orthogonal to the first direction and the second direction, the partition wall is located in the first direction from the first fixed contact and the first movable contact, and at least a part of the partition wall overlaps the first fixed contact when viewed in the first direction.

2. The contact point device according to claim 1, wherein the partition wall extended along the second direction when viewed in the first direction.

3. The contact point device according to claim 1, wherein at least one of the first space and the second space is at least a part of an extension space where an arc can be extended.

4. The contact point device according to claim 3 further comprising a bottom wall located in the first direction from the first space and the second space, and facing the first space and the second space, wherein the partition wall is located between the bottom wall and the first movable contact.

5. The contact point device according to claim 4, wherein the shielding wall has a side wall that protrudes from a peripheral edge of the bottom wall in a direction opposite to the first direction.

6. The contact point device according to claim 1 further comprising:

a drive shaft that moves the movable contactor in parallel with the first direction; and a wall portion that is tubular and disposed inside the containing chamber and surrounds the drive shaft.

7. The contact point device according to claim 1 further comprising a permanent magnet that generates a magnetic flux directed in the second direction between the first fixed contact and the first movable contact.

8. The contact point device according to claim 7, wherein the permanent magnet is disposed at a position aligned with the movable contactor in the second direction.

9. The contact point device according to claim 8, wherein the permanent magnet is disposed at a position aligned with the movable contactor in the third direction.

10. The contact point device according to claim 1, wherein the partition wall has electrical insulation.

11. The contact point device according to claim 1 further comprising an second fixed contact, wherein the movable contactor further has a second movable contact, and the second movable contact faces the second fixed contact.

12. An electromagnetic relay comprising:

the contact point device according to claim 1; and an electromagnet device having an exciting coil.

13. The electromagnetic relay according to claim 12, wherein the electromagnet device has a yoke that a magnetic flux generated by the exciting coil passes through, the yoke includes a first yoke disposed between the movable contactor and the exciting coil, and the contact point device further includes a cover that has electrical insulation, the cover being disposed between the first yoke and the movable contactor to cover the first yoke.

* * * * *